US008287236B2

(12) United States Patent
Nishida et al.

(10) Patent No.: US 8,287,236 B2
(45) Date of Patent: Oct. 16, 2012

(54) MULTISTAGE CENTRIFUGAL COMPRESSOR

(75) Inventors: Hideo Nishida, Tokyo (JP); Hiromi Kobayashi, Tokyo (JP); Masanori Tanaka, Tokyo (JP); Tadaharu Kishibe, Tokyo (JP); Manabu Yagi, Tokyo (JP); Tetsuya Kuwano, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 1196 days.

(21) Appl. No.: 12/117,288

(22) Filed: May 8, 2008

(65) Prior Publication Data

US 2008/0279680 A1 Nov. 13, 2008

(30) Foreign Application Priority Data

May 10, 2007 (JP) ..... 2007-125958

(51) Int. Cl.
*F04D 1/10* (2006.01)

(52) U.S. Cl. ..... 415/199.2; 415/206; 415/211.2

(58) Field of Classification Search ..... 415/191, 415/199.2, 206, 211.2
See application file for complete search history.

(56) References Cited

U.S. PATENT DOCUMENTS 3,361,073 A * 1/1968 Medgyesy ..... 415/215.1
5,344,285 A * 9/1994 O'Sullivan et al. ..... 415/199.2
6,345,503 B1 2/2002 Gladden
7,338,255 B2 * 3/2008 Nabesaka et al. ..... 415/173.6
8,075,260 B2 * 12/2011 Aki et al. ..... 415/199.2

FOREIGN PATENT DOCUMENTS

| | | | |
|---|---|---|---|
| DE | 1428 255 | | 1/1969 |
| DE | 38 35 341 | A1 | 4/1990 |
| EP | 0 359 514 | A2 | 3/1990 |
| EP | 0 703 368 | A2 | 3/1996 |
| FR | 644751 | | 10/1928 |
| FR | 1.306.368 | | 10/1962 |
| FR | 1.337.460 | | 9/1963 |
| GB | 460489 | | 1/1937 |
| GB | 690951 | | 4/1953 |
| GB | 2 181 785 | A | 4/1987 |
| JP | 2006-152994 | A | 6/2006 |

OTHER PUBLICATIONS

Japanese Office Action dated May 26, 2009 (Nine (9) sheets).

* cited by examiner

*Primary Examiner* — Ninh H Nguyen
(74) *Attorney, Agent, or Firm* — Crowell & Moring LLP

(57) ABSTRACT

A multistage centrifugal compressor includes a rotary shaft, and multistage impellers attached to the rotary shaft. Each of the impellers includes a hub, a shroud and blades therebetween in a radial cascade arrangement. An annular suction passage for guiding the fluid flow from the inward radial direction to a blade inlet is disposed upstream of the centrifugal impeller. A diffuser is disposed downstream of the centrifugal impeller. A bend portion is disposed downstream of the diffuser, and a return channel with a guide blade portion is disposed downstream of the bend portion. The annular suction passage at a hub side includes an axial parallel portion.

4 Claims, 4 Drawing Sheets

MULTISTAGE CENTRIFUGAL COMPRESSOR

CLAIM OF PRIORITY

The present application claims priority from Japanese application JP2007-125958 filed on May 10, 2007, the content of which is hereby incorporated by reference into this application.

BACKGROUND OF THE INVENTION

The present invention relates to a multistage centrifugal compressor, and more particularly, to a multistage centrifugal compressor including an annular suction passage upstream of a centrifugal impeller.

Japanese Unexamined Patent Application Publication No. 2006-152994 discloses a multistage centrifugal compressor provided with an annular suction passage for guiding the flow at the outlet of the return channel in the former stage to the blade inlet, the centrifugal impeller, the diffuser disposed downstream of the centrifugal impeller, and the return channel for guiding the fluid at the outlet of the diffuser to the next stage. The annular suction passage has each shape at the hub side and the shroud side connected with a smooth curve, and has the passage cross-section area of the annular suction passage at the eye portion (where the radius of the passage at the shroud becomes minimum) set to be larger than that of the blade inlet so as to prevent deceleration of the flow passing from the eye portion to the blade inlet.

In order to form the suction passage into the smooth shape, and to make the passage cross-section area of the eye portion larger than that of the blade inlet, the minimum radius of the suction passage at the hub side has to be reduced. The diameter of the rotary shaft has to be reduced to lower the critical speed of the rotary shaft system. The reduction in the critical speed may cause the problem of failing to increase the operation speed of the compressor.

The minimum radius of the passage at the hub side may be increased to prevent reduction in the critical speed. In the case where the suction passage is formed into the smooth shape, and the area of the eye portion is made larger than that of the blade inlet, the radius of the blade inlet is increased, and accordingly, the relative speed at the inlet is also increased to further bring the frictional loss against the impeller and the deceleration loss into the serious state. The efficiency of the compressor, thus, is deteriorated.

BRIEF DESCRIPTION OF THE INVENTION

It is an object of the present invention to provide a multistage centrifugal compressor capable of improving the efficiency of the compressor by preventing reduction in the critical speed of the rotary shaft system or suppressing reduction in the critical speed to be within the allowable range while maintaining the efficiency of the compressor.

According to a first aspect of the present invention, a multistage centrifugal compressor includes a rotary shaft, a centrifugal impeller formed of a hub, a shroud, and blades in a radial cascade arrangement between the hub and shroud and attached to the rotary shaft in plural stages, an annular suction passage disposed upstream of the centrifugal impeller to guide a fluid flow from an inward radial direction to a blade inlet, a diffuser disposed downstream of the centrifugal impeller, and a return channel formed of a bend portion disposed downstream of the diffuser and a guide blade portion disposed downstream of the bend portion. An axial parallel portion is disposed in the annular suction passage at a hub side.

The first aspect of the present invention provides the following preferred exemplary structures.

(1) The annular suction passage at the hub side is formed of the axial parallel portion and a curve portion.

(2) A passage cross-section area of the annular suction passage at a position where a radius at a shroud side becomes minimum is made smaller than a passage cross-section area of the blade inlet.

(3) The passage cross-section area of the annular suction passage at the position where the radius at the shroud side becomes minimum is made smaller to be 70% to 95% of a passage cross-section area of the blade inlet.

(4) An average flow velocity in the annular suction passage at the position where the radius at the shroud side becomes minimum is made 1.45 to 1.05 times higher than an average flow velocity at the blade inlet.

According to a second aspect of the present invention, a multistage centrifugal compressor includes a rotary shaft, a centrifugal impeller formed of a hub, a shroud, and blades in a radial cascade arrangement between the hub and shroud and attached to the rotary shaft in plural stages, an annular suction passage disposed upstream of the centrifugal impeller to guide a fluid flow from an inward radial direction to a blade inlet, a diffuser disposed downstream of the centrifugal impeller, and a return channel formed of a bend portion disposed downstream of the diffuser and a guide blade portion disposed downstream of the bend portion. A passage cross-section area of the annular suction passage at a position where a radius at a shroud side becomes minimum is made smaller than that of the blade inlet.

The second aspect of the present invention provides the following preferred exemplary structure.

(1) A minimum cross-section area of the annular suction passage is set to be 70% to 95% of the cross-section area of the blade inlet.

The multistage centrifugal compressor according to the present invention is capable of improving the efficiency of the compressor without decreasing the critical speed of the rotary shaft system.

DETAILED DESCRIPTION OF THE INVENTION

Figure 1:
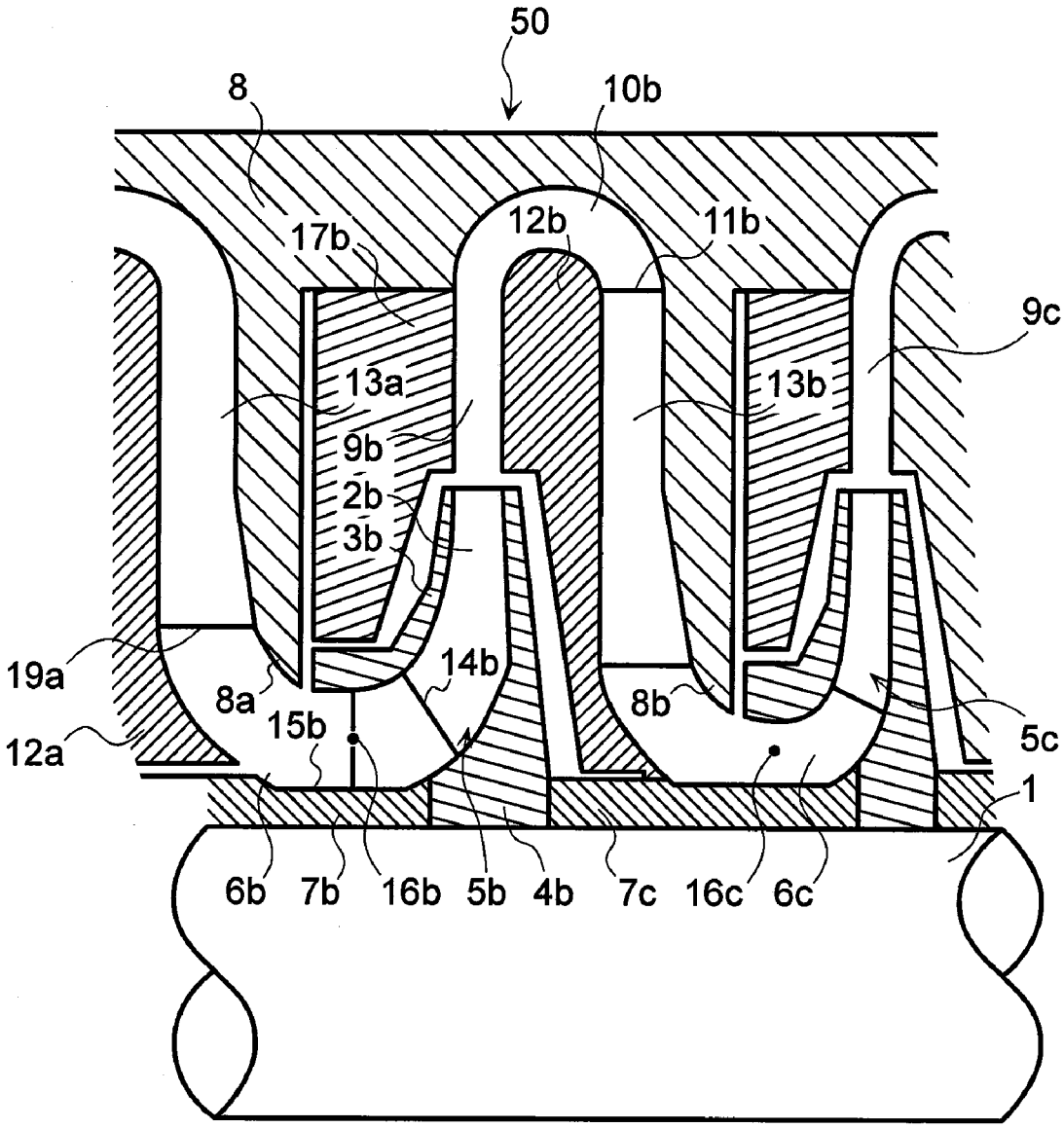
FIG. 1 is a vertical section of an essential portion of a multistage centrifugal compressor according to an embodiment of the present invention.
Figure 2:
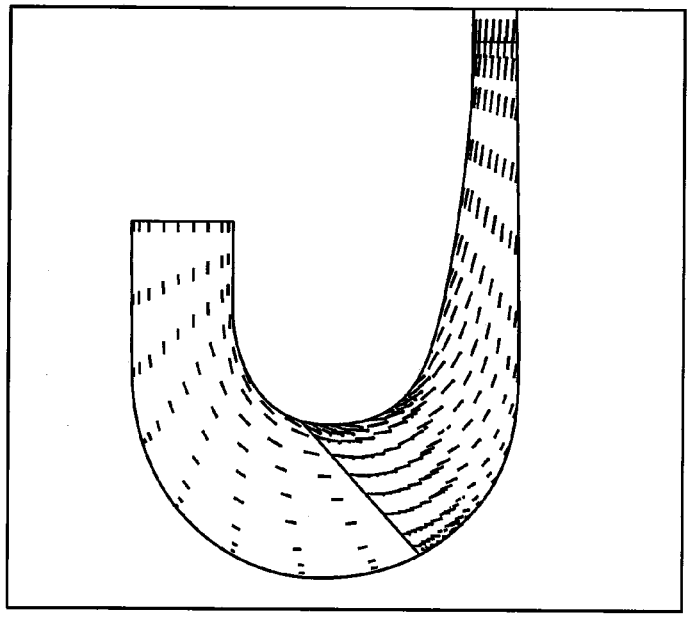
FIG. 2 is a view showing the velocity vector derived from the viscous flow analysis on the cross-section of the impeller with the generally employed suction passage.
Figure 3:
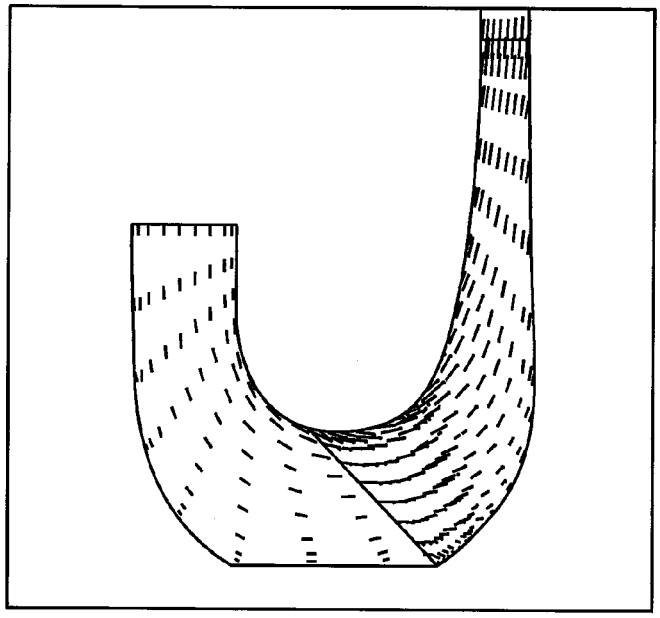
FIG. 3 is a view showing the velocity vector derived from the viscous flow analysis on the cross-section of the impeller of the multistage centrifugal compressor with the annular suction passage as shown in FIG. 1.

A multistage centrifugal compressor according to an embodiment of the present invention will be described referring to FIGS. 1 to 3. FIG. 1 is a vertical section of an essential portion of the multistage centrifugal compressor according to the embodiment. FIG. 2 is a view showing the velocity vector derived from the viscous flow analysis on the cross-section of the impeller with the generally configured annular suction passage. FIG. 3 is a view showing the velocity vector derived from the viscous flow analysis on the cross-section of the impeller with the annular suction passage shown in FIG. 1. The multistage centrifugal compressor 50 includes a rotary shaft 1, a centrifugal impeller 5*b* formed of a hub 4*b*, a shroud 3*b*, and blades 2*b* in a radial cascade arrangement between the plates 4*b* and 3*b*, an annular suction passage 6*b* disposed upstream of the centrifugal impeller 5*b* to guide the fluid flow from the inward radial direction to a blade inlet 14*b*, a diffuser 9*b* disposed downstream of the centrifugal impeller 5*b*, and a return channel 13*b* formed of a bend portion 10*b* disposed downstream of the diffuser 9*b* and a guide blade 11*b* disposed downstream of the bend portion 10*b*.

FIG. 1 mainly shows the centrifugal impeller 5*b* at the second stage of the multistage centrifugal compressor 50, and each alphabet designated to the respective components, a, b, and c denotes the number of the stage in the order from the first stage. The respective components at the second stage will be described hereinafter.

The rotary shaft 1 having both ends supported with bearings is connected to a drive source so as to be rotated at high speeds. The rotary shaft 1 is provided with the multistage centrifugal impellers 5*b*, 5*c* for accommodating the fluid from the axial direction so as to be discharged in the radial direction.

A pair of partition plates 12*b* and 17*b* is provided at both sides of the centrifugal impeller 5*b*. The diffuser 9*b* defined by the pair of the partition plates 12*b*, 17*b* opposite with each other is disposed at the outer side of the impeller 5*b* in the radial direction. The bend portion 10*b* defined by the partition plate 12*b* and a casing 8, and the guide blade 11*b* defined by the partition plate 12*b* and a partition portion 8*b* of the casing 8 constitute the return channel 13*b* at the outlet of the diffuser 9*b*. The guide blade portion 11*b* is provided with plural guide blades.

The annular suction passage 6*b* formed of the partition plate 12*a* in the former stage, a partition portion 8*a* in the former stage, a sleeve 7*b* at the hub side, the hub 4*b*, and the shroud 3*b* is formed between an outlet 19*a* of the return channel 13*a* in the former stage and the blade inlet 14*b*. The surface of the suction passage 6*b* at the shroud side has a smooth curve. The surface of the annular suction passage 6*b* at the hub side is formed by connecting a smooth curve portion at the inlet side, an axial parallel portion 15*b* from the middle of he smooth curve portion, and a smooth curve portion from the axial parallel portion 15*b* to the blade inlet 14*b*.

The passage cross-section area of the annular suction passage 6*b* at an eye portion 16*b* (the position where the radius of the passage at the shroud side becomes minimum) is smaller than that at the blade inlet 14*b*, more specifically, approximately 70% to 95% of the passage cross-section area of the blade inlet 14*b*. In this case, the average flow velocity in the annular suction passage at the eye portion 16*b* is 1.45 to 1.05 times (1/0.7 to 1/0.95) higher than that at the blade inlet 14*b*.

The flow at the outlet 19*a* of the return channel 13*a* in the former stage in the inward radial direction is guided through the annular suction passage 6*b* to the blade inlet 14*b*, and further to be accommodated into the blades 2*b* of the impeller 5*b*. The fluid with its pressure raised by the blades 2*b* of the impeller 5*b* is decelerated by the diffuser 9*b* such that the kinetic energy is converted into the pressure energy. The flow in the outward radial direction is changed to be directed to the inward radial direction through the return channel 13*b*, and is further guided to the annular suction passage 6*c* in the next stage. The fluid guided to the annular suction passage 6*c* in the next stage has its pressure raised by the centrifugal impeller 5*c* so as to be discharged to the diffuser 9*c*.

In the embodiment, the use of the axial parallel portion 15*b* on the surface of the annular suction passage 6*b* at the hub side makes it possible to increase the minimum radius of the surface of the passage at the hub side compared with the general case where the surface of the passage at the hub side is gently curved. Accordingly, the critical speed of the rotary shaft system may be increased, thus enhancing the compression performance by operating the compressor at high speeds. The diameter axial parallel portion 15*b* may further be enlarged to increase the number of stages of the multistage compressor.

In the embodiment, when the minimum radius is set to the same value as the one in the case where the surface of the generally configured annular suction passage at the hub side is gently curved, the radius of the blade inlet may be made smaller than the one in the conventional case. As the relative speed at the blade inlet is reduced to decrease the impeller loss, the impeller efficiency, and further the compressor efficiency may be improved compared with the conventional machine.

In the embodiment, as the axial parallel portion 15*b* is formed on the surface of the annular suction passage 6*b* at the hub side, the turbulence in the fluid flow may occur. As the cross-section area of the annular suction passage 6*b* at the eye portion 16*b* is made smaller than that of the blade inlet 14*b*, the flow velocity in the section with the reduced cross-section area may be decreased, thus increasing the loss.

The viscous flow analysis was performed with respect to the generally configured annular suction passage and the annular suction passage according to the embodiment. FIGS. 2 and 3 show the velocity vector distributions on the cross-section of the impeller with respect to the generally configured annular suction passage, and the annular suction passage according to the embodiment, respectively. Referring to the velocity vector with respect to the annular suction passage of the embodiment, the velocity vector distribution is in good condition with substantially no large turbulence likewise the velocity vector of the generally configured annular suction passage.

Figure 4:
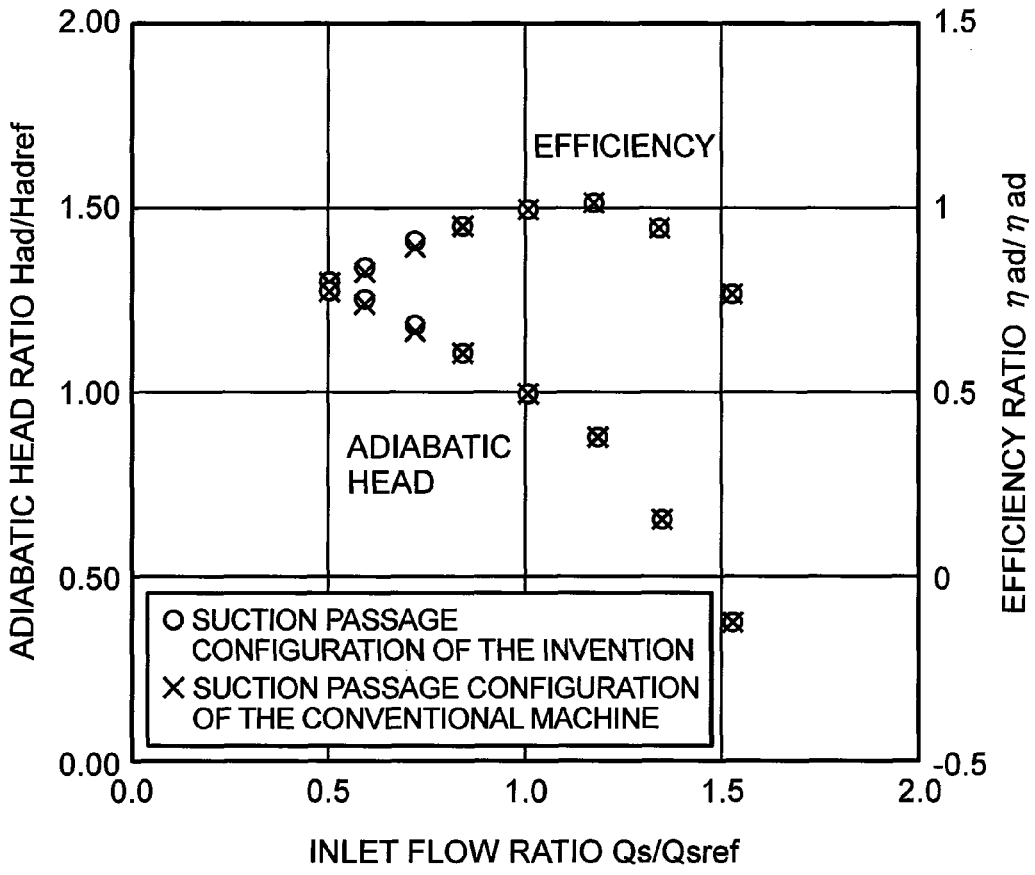
FIG. 4 is a view showing the comparison of results of the performance forecast between the multistage centrifugal compressor with the annular suction passage as shown in FIG. 1 and the centrifugal compressor with the generally configured annular suction passage.
Figure 5:
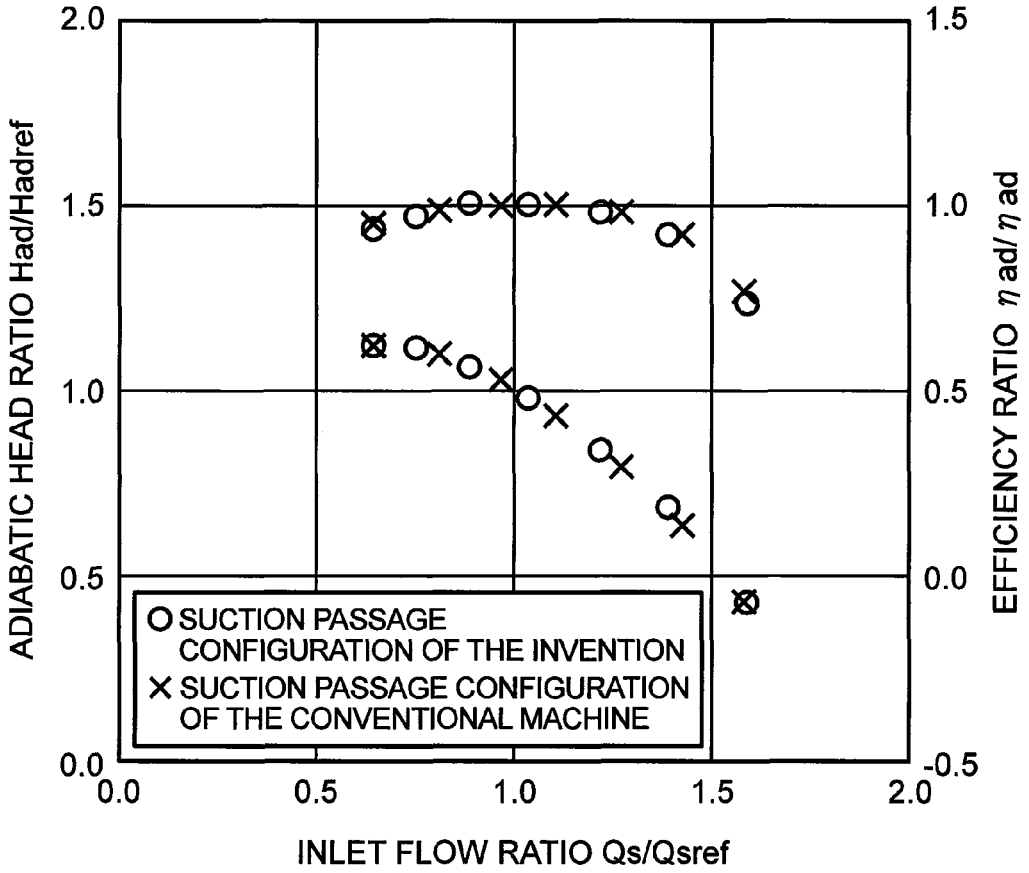
FIG. 5 is a view showing experimental results corresponding to those shown in FIG. 4.

The results of the comparison in the performance of the centrifugal compressor (viscous analysis calculation values) between the annular suction passage of the embodiment and the generally configured annular suction passage are shown in FIG. 4. As is clear by referring to FIG. 4, each case has substantially the same efficiency and the adiabatic head. The experimental results corresponding to FIG. 4 are shown in FIG. 5 representing the results substantially the same as those of the performance forecast as described above. The effectiveness of the embodiment, thus, is further confirmed.

In the embodiment, the passage cross-section area at the eye portion 16*b* is made smaller to be 70% to 95% of that of the blade inlet 14*b*. This makes it possible to increase the minimum radius of the surface of the passage at the hub side compared with the case where the annual suction passage is gently curved as in the conventional machine, or the axial parallel portion is formed simply on the surface of the annular suction passage at the hub side. This makes it possible to allow the compressor to be operated at high speeds, and to improve the efficiency of the compressor.

When the passage cross-section area at the eye portion 16*b* is made smaller to be 70% or less of that of the blade inlet, the flow may deviate from the wall surface of the annular suction passage at the shroud, thus deteriorating the performance of the compressor

What is claimed is:

1. A multistage centrifugal compressor comprising:

a rotary shaft;

a centrifugal impeller formed of a hub, a shroud, and blades in a radial cascade arrangement between the huh and shroud and attached to the rotary shaft in a plurality of stages;

an annular suction passage disposed upstream of the centrifugal impeller to guide a fluid flow from an inward radial direction to a blade inlet;

a diffuser disposed downstream of the centrifugal impeller;

and a return channel formed of a bend. portion disposed downstream of the diffuser and a guide blade portion disposed downstream of the bend portion, wherein an axial parallel portion is disposed in the annular suction passage at a side of the hub, and a passage cross-section area of the annular suction passage at a position where a radius at a shroud side becomes a minimum is 70%-95% of a passage cross-section area of the blade inlet.

2. The multistage centrifugal compressor according to claim 1, wherein the annular suction passage at a hub side is formed of the axial parallel portion and a curve portion.

3. The multistage centrifugal compressor according to claim 2, wherein an average flow velocity in the annular suction passage at the position where the radius at the shroud side becomes minimum is made 1.45 to 1.05 times higher than an average flow velocity at the blade inlet.

4. The multistage centrifugal compressor according to claim 1, wherein an average flow velocity in the annular suction passage at the position where the radius at the shroud side becomes minimum is made 1.45 to 1.05 times higher than an average flow velocity at the blade inlet.

* * * * *